8/30/83 XR 4,401,976

United States Patent [19]

Stadelmayr

[11] 4,401,976

[45] Aug. 30, 1983

[54] MULTIPLE SENSOR INTERCONNECTED ALARM SYSTEM RESPONSIVE TO DIFFERENT VARIABLES

[76] Inventor: Hans-Günther Stadelmayr, Wilhelm-Ostwaldstr. 5, D 8000 Munich 40, Fed. Rep. of Germany

[21] Appl. No.: 225,000

[22] Filed: Jan. 14, 1981

[30] Foreign Application Priority Data

Jan. 16, 1980 [DE] Fed. Rep. of Germany ..... 3001452
Dec. 29, 1980 [EP] European Pat. Off. ..... 80108235.5

[51] Int. Cl.[3] ..... G08B 13/16; G08B 13/18

[52] U.S. Cl. ..... 340/522; 340/508; 340/541; 340/554; 367/94

[58] Field of Search ..... 340/522, 541, 508, 554; 367/94

[56] References Cited

U.S. PATENT DOCUMENTS 3,541,539 11/1970 Trumble ..... 340/522
3,725,888 4/1973 Solomon ..... 367/94
3,801,978 4/1974 Gershberg et al. ..... 367/94
3,846,778 11/1974 Galvin et al. ..... 340/522

FOREIGN PATENT DOCUMENTS 50-26198 8/1975 Japan ..... 340/522

*Primary Examiner*—Glen R. Swann, III
*Attorney, Agent, or Firm*—Sughrue, Mion, Zinn, Macpeak and Seas

[57] ABSTRACT

An alarm, safeguarding and monitoring system for a room zone includes a plurality of sensors disposed at different positions and responsive to different physical phenomena, such as an ultrasonic sensor, an infrared sensor and a microwave sensor. The sensor outputs are individually coupled to majority decision, central processing unit and alarm generator circuits by a plurality of redundant signal links to minimize malfunction in the event of disruption or tampering.

16 Claims, 2 Drawing Figures

US sensor
IR sensor
IR * sensor
MW * sensor
sign. izer
signal-izer
majority circuit
processing unit
alarm gen.
coder
relay station
S/US

MULTIPLE SENSOR INTERCONNECTED ALARM SYSTEM RESPONSIVE TO DIFFERENT VARIABLES

The invention relates to an alarm, safeguarding and monitoring system having a plurality of sensors and located in one room.

BACKGROUND OF THE INVENTION

From U.S. Pat. No. 3,801,978 a monitoring or alarm system is known having two sensors located in one room and working according to the Doppler principle, said sensors responding to at least two physical phenomena of different nature but occurring inevitably in every event of alarm, and covering the same monitoring zone. An increased degree of safety is achieved with this known system in comparison to conventional commercial alarm systems. But in spite of this there is still a considerable susceptibility to sabotage and a high error rate.

SUMMARY OF THE INVENTION

The invention therefore provides an alarm, safeguarding and monitoring system wherein the known cases of susceptibility to trouble, such as, e.g., failure to respond, false alarms and possibilities of sabotage are almost completely excluded. According to the invention at least three sensors are provided which respond to different physical phenomena that occur inevitably in every alarm situation, or else respond to the same physical phenomena in a different way, or in two or more different ways, said sensors covering the same monitoring zone, and working together according to the majority principle. Accordingly, an alarm is only set off if more than half of all the sensors or sensor pairs working together according to the Doppler principle give an alarm signal to the transmission channel or channels in the direction of the central processing unit. This ensures that the effectiveness of the system is not impaired by the failure of one of the sensors or by an influence on or bypassing of the same.

According to a preferred embodiment, three or more sensors are employed which respond to three or more different physical phenomena. It is especially advantageous if at least two of the sensors work according to the Doppler principle and if these are disposed angularly to one another—an orthogonal arrangement produces as a rule the best results.

It is useful to have two ultrasonic sensors and one infrared sensor, or two microwave sensors and one infrared sensor. A further increased degree of monitoring precision can be obtained if, according to a further development of this arrangement, one provides two microwave-ultrasonic sensor pairs disposed angularly to one another and one infrared sensor which is preferably located separate from the sensor pairs.

As far as linkage of the sensors is concerned, it is expedient if the individual sensors acting according to the Doppler principle are linked via an AND circuit. It is advantageous if a sensor pair working according to the Doppler principle, of which pair the individual sensors are connected in an OR circuit, is linked with another sensor and/or another sensor pair working according to the Doppler principle, whose individual sensors are connected in OR circuit, by means of an AND circuit.

Regarding the signal connections, it is expedient to provide between different functional groups at least two signal paths which are independent of one another and which interact advantageously according to lateral inhibition. The term lateral inhibition, which was coined by Nobel prize winner von Bekesy, means the mutual inhibition of parallel members, as has also come into use in the field of communication engineering.

In the case of endangered signal connections between different functional groups, it is expedient that these signal connections have at least three signal paths which are independent of one another and which interact via a majority logic in the sense mentioned above.

If the system is to be portable, it is advisable to design the signal paths by means of the combined use of the mains, radio and independent wiring.

The safety of the system can be further improved by providing at the end of each signal path a circuit which responds to interferences in said signal path and which generates an alarm.

The independent signal paths can be designed in simple manner from devices for the utilization of several different signal transmission frequency band widths or different pulse sequences on the same medium. It is also useful if a continuous signal is transmitted via radio and monitored to indicate inoperativeness, and whose coded modulated disturbance signal sets off an alarm.

It is further advisable to have the mains connected to the alarm system or automatic information transmission system so that if there is a power failure a general or special alarm, which differs from the main alarm, is set off for each individual unit of the entire system.

In the case of exposed operational blocks it is advisable to have a separate protection against sabotage which can be effected by means of mechanical vibration signalizers with a delay circuit.

Especially sensitive areas of the alarm system are the activate/deactivate circuit or on/off circuit, since these must be located outside the monitored region. Here too it is advisable to have at least two signal paths which are independent of one another, and if possible not to use any special connection wiring, so that even if the on/off switch, peripheral monitoring or actuating units are located this does not lead to location of the central processing unit or to its destruction by a heavy current. Similar considerations apply also for the coding of the central processing unit, which coding ensues expediently via an external unit which has no direct connecting path to the central processing unit. In the case of already-existing systems or in cases where permanent connection leads are unavoidable, it is a good idea to insert a galvanic interruption which can be expediently effected by means of a relay circuit. With regard to the signal paths it is finally also advisable if each individual channel further signalizes, by means of a special device, any disturbances in any other channel.

Protective coincidence circuits prevent different response times of the sensors, different transfer and transmission times from different channels and different processing times of any intermediate elements from endangering the coincidence of the alarm signals, which could under certain conditions result in no alarm being generated even if there is cause for an alarm.

If more than three sensors are used in the same room area, and this applies in particular for an even number of sensors, it is advantageous with respect to the majority evaluation to count one pair of individual sensors as a single unit. This can also ensue, however, by means of some other majority or minority protection.

The installation of the system is facilitated in that different types of sensors are integrated into one casing.

DETAILED DESCRIPTION OF THE PREFERRED EMBODIMENTS

Figure 1:
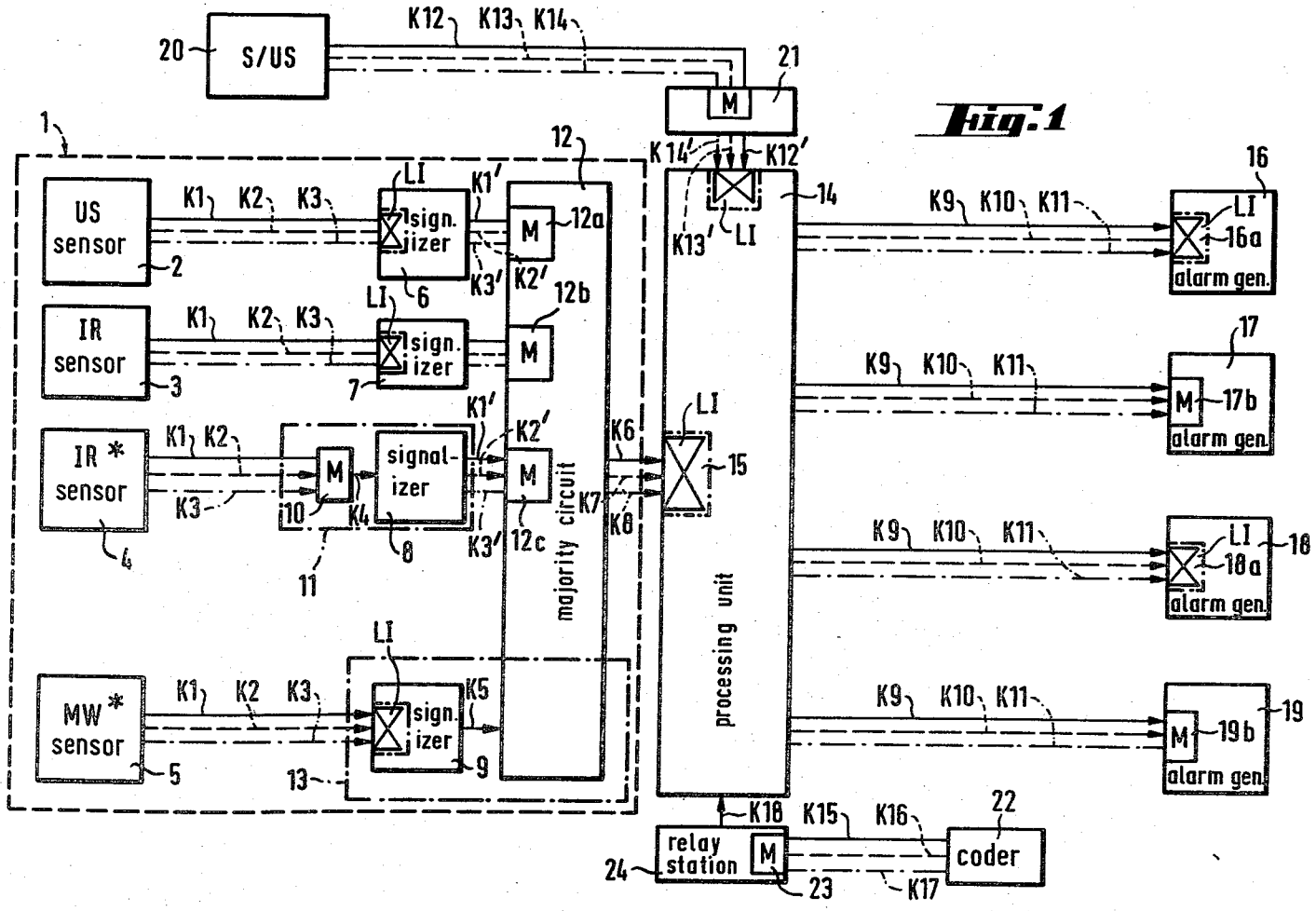
FIG. 1 shows a block diagram of an alarm, safeguarding and monitoring system where different design possibilities have been realized.

In the block diagram of FIG. 1 the dashed frame 1 designates a monitoring zone, e.g. a room. In the monitoring zone 1 there are four sensors 2–5, of which sensor 2 is an ultrasonic sensor, sensors 3 and 4 infrared sensors and sensor 5 a microwave sensor. The sensors are each connected via three separate transmission channels K1–K3 to signalizers 6–9. Channels K1–K3 can be part of an already existing wiring system, a wiring network installed especially for the alarm system, or a radio transmission path. The different types of lines show that the three channels K1, K2 and K3 represent in each case separate transmission paths. In the signalizers 6, 7 and 9 there is a lateral inhibition member—designated in each case LI—which effects the mutual monitoring of the channels leading to these signalizers. In the channels leading to signalizer 8, however, there is a majority circuit 10—designated M—which evaluates according to the majority principle the signals passed through the corresponding channels K1, K2 and K3 and subsequently triggers signalizer 8 via a channel K4.

Signalizer 8 and the majority circuit 10 are accommodated in a common housing 11, indicated by a dot-dash line, which is additionally safeguarded against sabotage by means of a mechanical vibration signalizer not shown in detail.

From signalizers 6, 7 and 8 three separate channels K1', K2' and K3' lead to a majority circuit 12, to which a further channel K5 from signalizer 9 also leads. In the majority circuit 12, as shown by reference characters 12*a*, 12*b* and 12*c*, the signals transmitted via the leads K1', K2' and K3' are first of all evaluated according to the majority principle, according to which the overall evaluation ensues, i.e. a check is made as to whether the majority of the signalizers 6–9 have signalled an alarm situation.

Reference character 13 indicates that signalizer 9 and the majority circuit 12 are integrated in a unitary housing, which may be additionally safeguarded, and also that signalizer 9 is given preference with respect to each of the other signalizers 6–8 for the majority evaluation. (Instead of a preference, which corresponds to a majority protection, a discrimination could be provided for this signalizer which would correspond to that of a minority protection.)

From the majority circuit 12 three independent channels K6, K7 and K8 lead to the evaluation unit 14, which can e.g. be the central processing unit. The channels K6 to K8 are monitored by means of a lateral inhibition circuit 15 in the central processing unit 14. From the central processing unit 14 channels K9, K10 and K11 lead to different alarm generators 16–19, the mutual channel monitoring in alarm generators 16 and 18 being effected by a lateral inhibition member 16*a*, 18*a* and in alarm generators 17 and 19 by majority circuits 17*b* and 19*b*.

The system is switched on and off by means of an activate/deactivate circuit S/US 20, which is installed separate from the central processing unit and which is connected to the latter via independent channels K12–K14. The channels K12–K14 lead first to a transmitter 21, which then controls the central processing unit 14 via channels K12'–K14'. This measure guarantees that the central processing unit cannot be located from the on-and-off unit 20, and also cannot be destroyed.

Also interacting with the central processing unit 14 is a coder 22, which is connected via channels K15, K16, K17 and perhaps a majority circuit 23 to a relay station 24 that acts via a channel K18 on the central processing unit. The relay station 24 constitutes a galvanic interruption between the coder 22 and the central processing unit 14, and thus likewise prevents any possible destruction originating from the coder.

In the operating condition shown in FIG. 1 sensors 4 and 5 are excited, as is indicated by a small asterisk in the interior of each box. Sensors 2 and 3, on the other hand, are not excited. Sensors 4 and 5 thus send via their associated channels K1–K3 signals to the majority circuit 10 and signalizer 9 respectively; in the case shown the channel K1 between sensor 4 and the majority circuit 10 is destroyed. This is shown in the drawing by the absence of a corresponding arrow in this channel, while the arrows in the other channels show that a signal is being transmitted. Via channel K4 majority circuit 10 triggers signalizer 8, which for its part, via channels K1' and K2', passes on the alarm signal to majority circuit 12, Channel K3' is in this case likewise disturbed and inoperable, for reasons not explained in more detail. Signalizer 9 also passes on a signal to majority circuit 12, via channel K5. The majority circuit 12 now establishes that no signal has been delivered by the internal majority circuits 12*a* and 12*b* but that there is a corresponding signal from internal majority circuit 12*c* and likewise from signalizer 9 via channel K5. Since signalizer 9 is preferred by means of circuit 13, the majority circuit 12 decides that there is an alarm condition and passes on this decision via channels K6–K8 to the central processing unit 14, which, via channels K9–K11, triggers the alarm generators 16–19. A disturbance in transmission channel K10 leading to alarm generator 16 and in transmission channel K11 leading to alarm generator 19 has no effect, since the lateral inhibition circuit 16*a* and majority circuit 19*b* still ascertain with certainty that there is a valid alarm.

Figure 2:
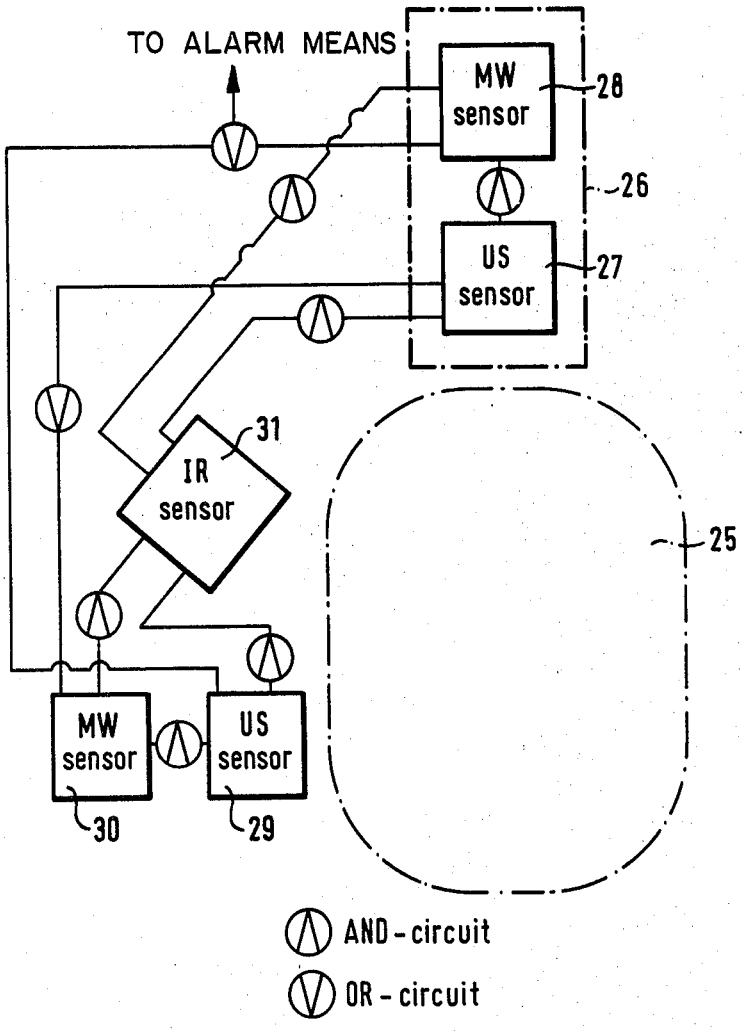
FIG. 2 shows an example of a system in which two pairs of sensors working according to the Doppler principle are provided, including various possibilities for linking the individual sensors—in simplified schematic form.

FIG. 2 shows schematically the arrangement and linkage of a plurality of sensors disposed to monitor a zone or area 25, such as a room.

These constitute two pairs of sensors based on the Doppler principle, the first pair being accommodated in a common casing 26 and comprising an ultrasonic sensor 27 and a microwave sensor 28, and the second pair, comprising an ultrasonic sensor 29 and a microwave sensor 30, being disposed separate from one another. With regard to their transmitting and receiving directions, the sensor pairs formed by sensors 27, 28 and 29, 30 are disposed orthogonally to one another. Between the two pairs of sensors and oblique to them is an infrared sensor 31. The sensors are connected with one another by AND or OR circuits, as shown by the corresponding symbols in FIG. 2. This means that the ultrasonic sensor 27 and the microwave sensor 28 of the first sensor pair are connected with one another in an AND circuit. The same applies for the microwave sensor 30 and the IR sensor 31, the ultrasonic sensor 29 and the IR sensor 31, the microwave sensor 28 and the IR sensor 31 as well as the microwave sensor 30 and the ultrasonic sensor 29, and the ultrasonic sensor 27 and the IR sensor 31.

The linkage between the microwave sensor 30 and the ultrasonic sensor 27 ensues via an OR circuit. The linkage between the ultrasonic sensor 29 and the microwave sensor 28 likewise ensues via an OR circuit. Alternatively, the outputs of the sensors 30, 28 and 29, 27 may also be fed to OR circuits. Details of the wiring and the interconnection with the central processing unit have not been shown for reasons of clarity.

The sensor types described in the Figures are merely examples; besides the ultrasonic sensors, microwave sensors and infrared sensors mentioned one can naturally also employ capacitive signalizers, mechanical vibration signalizers, broken glass sensors, video cameras, reed and double reed contacts etc. The alarm generators can be optical and acoustic devices, such as flash signals and sirens, or telephone or radio dialling devices.

I claim:

1. Alarm, safeguarding and monitoring system having a plurality of sensors in one room, comprising: at least three sensors which respond to physical phenomena of a different nature which always occur in every alarm event, said sensors being disposed to cover the same monitoring zone, and means responsive to output signals from said sensors for generating an alarm signal according to the majority principle.

2. Alarm, safeguarding and monitoring system according to claim 1, wherein three sensors respond to three different physical phenomena.

3. Alarm, safeguarding and monitoring system, according to claim 2, wherein at least two of the sensors work according to the Doppler principle and are disposed angularly with respect to one another.

4. Alarm, safeguarding and monitoring system according to claim 3, wherein the sensors working according to the Doppler principle are disposed orthogonally with respect to one another.

5. Alarm, safeguarding and monitoring system according to claim 3, wherein the outputs of the individual sensors working according to the Doppler principle are fed to an OR circuit, whose output is coupled to said alarm signal generating means.

6. Alarm, safeguarding and monitoring system according to claim 3, wherein different types of sensors are integrated in one casing.

7. Alarm, safeguarding and monitoring system according to claim 3, wherein individual signal connections between different functional groups have at least three signal paths which are independent of one another and whose outputs are processed by a majority logic circuit.

8. Alarm, safeguarding and monitoring system according to claim 3, wherein an activate/deactivate circuit has at least two signal paths which are independent of one another.

9. Alarm, safeguarding and monitoring system according to claim 3, wherein an on/off circuit and peripheral monitoring and actuating units are not connected via any system wiring, so that even if these units are located this does not lead to the location or destruction of a central processing unit.

10. Alarm, safeguarding and monitoring system according to claim 9, wherein coding of the central processing unit ensues via an external unit which has no direct connecting path to the central processing unit.

11. Alarm, safeguarding and monitoring system according to claim 10, wherein in the case of permanent connection leads to on/off switches, monitoring and actuating units, a galvanic interruption is inserted into the connection leads.

12. Alarm, safeguarding and monitoring system according to claim 11, wherein the galvanic interruption is effected via a relay circuit.

13. Alarm, safeguarding and monitoring system according to claim 2, wherein two ultrasonic sensors and one infrared sensor are provided.

14. Alarm, safeguarding and monitoring system according to claim 2, wherein two microwave sensors and one infrared sensor are provided.

15. Alarm, safeguarding and monitoring system according to claim 2, wherein two sensor pairs disposed angularly to one another, each pair comprising a microwave sensor and an ultrasonic sensor, and one infrared sensor are provided.

16. Alarm, safeguarding and monitoring system according to claim 15, wherein the infrared sensor is disposed separate from the sensor pairs.

* * * * *